US007686754B2

(12) United States Patent
Harris et al.

(10) Patent No.: US 7,686,754 B2
(45) Date of Patent: Mar. 30, 2010

(54) DRUM FOR A CREASING DEVICE

(75) Inventors: Graham Harris, Leicester (GB); Paul Graham Barrett, Leicester (GB)

(73) Assignee: Tech-ni-Fold Ltd (GB)

( * ) Notice: Subject to any disclaimer, the term of this patent is extended or adjusted under 35 U.S.C. 154(b) by 0 days.

(21) Appl. No.: 11/805,653

(22) Filed: May 24, 2007

(65) Prior Publication Data

US 2007/0243988 A1 Oct. 18, 2007

Related U.S. Application Data

(63) Continuation of application No. PCT/GB2006/003057, filed on Aug. 16, 2006.

(30) Foreign Application Priority Data

Aug. 20, 2005 (GB) ..... 0517115.2

(51) Int. Cl.
*B31B 49/00* (2006.01)

(52) U.S. Cl. ..... 493/471; 493/160; 493/185; 493/396; 493/401

(58) Field of Classification Search ..... 493/471, 493/160, 161, 185, 396, 401, 402, 403; 72/370.06, 72/370.07, 370.08, 58, 59; 492/30, 47
See application file for complete search history.

(56) References Cited

U.S. PATENT DOCUMENTS 1,718,041 A * 6/1929 Galassi ..... 404/67
RE17,653 E * 4/1930 Schroeder et al. ..... 493/354
2,139,890 A * 12/1938 Fitchett ..... 493/401
2,806,413 A 9/1957 Crooke
3,157,398 A * 11/1964 Zahradnik ..... 493/397
3,318,206 A 5/1967 Kuehn
3,353,245 A * 11/1967 Madson ..... 492/48

(Continued)

FOREIGN PATENT DOCUMENTS

DE 119224 4/1901

(Continued)

OTHER PUBLICATIONS

International Search Report; International Application No. PCT/GB2006/003057; European Patent Office ; Date of actual completion Nov. 16, 2006; Date of mailing Nov. 30, 2006; 2 pages.

*Primary Examiner*—Hemant M Desai
(74) *Attorney, Agent, or Firm*—Reinhart Boerner Van Deuren P.C.

(57) ABSTRACT

A drum for a creasing device, a resilient creasing ring and method are provided. The drum includes first and second drum parts that cooperate with one another to define a circumferential channel of the drum a base and two side wall for receiving a resilient creasing ring. At least one of the side walls includes recess for receiving a portion of the resilient creasing ring such that the resilient creasing ring cannot be removed radially from the channel. The creasing ring may be continuous or a split ring. A method of mounting the creasing ring includes mounting the resilient creasing ring on a first drum part and axially sliding a second drum part into cooperation with the first drum part to mount the creasing ring within a channel formed therebetween.

8 Claims, 3 Drawing Sheets

U.S. PATENT DOCUMENTS

| | | | | | |
|---|---|---|---|---|---|
| 3,673,929 | A | * | 7/1972 | Saunders | 493/471 |
| 3,827,340 | A | | 8/1974 | Keck | |
| 3,880,030 | A | * | 4/1975 | Rosengren | 83/863 |
| 4,289,492 | A | | 9/1981 | Simpson | |
| 4,936,818 | A | | 6/1990 | Holohan, Jr. | |
| 5,045,045 | A | | 9/1991 | Davenport et al. | |
| 5,133,235 | A | * | 7/1992 | DeVito | 83/347 |
| 5,409,442 | A | | 4/1995 | Smithwick, Jr. | |
| 5,873,807 | A | * | 2/1999 | Lauderbaugh et al. | 493/403 |
| 6,508,751 | B1 | * | 1/2003 | Weishew et al. | 493/59 |
| 6,572,519 | B1 | * | 6/2003 | Harris | 493/395 |

FOREIGN PATENT DOCUMENTS

| | | | |
|---|---|---|---|
| GB | 23235 | | 9/1899 |
| GB | 2 347 897 | | 9/2000 |
| WO | WO 00/55080 | A1 | 9/2000 |
| WO | WO 2004/073966 | A1 | 9/2004 |
| WO | WO 2004/078469 | | 9/2004 |

* cited by examiner

DRUM FOR A CREASING DEVICE

CROSS-REFERENCE TO RELATED PATENT APPLICATIONS

This patent application is a continuation of PCT/GB2006/003057 filed Aug. 16, 2006, designating the United States, which claims the benefit of British Application No. 0517115.2 filed Aug. 20, 2005, the teachings and disclosures, of both references, are hereby incorporated in their entireties by reference thereto.

FIELD OF THE INVENTION

This invention relates to the drum that mounts a resilient creasing ring in a device for creasing stock such as paper, card, film, foil or other sheet material to enable it to be easily folded. The device is especially well suited for fitting to the output of a printing machine or the input of a folding machine but it can also be used in a stand-alone creasing machine or in other contexts.

BACKGROUND OF THE INVENTION

A high percentage of printed stock such as book covers or greetings cards needs to be creased before the next operation of folding can be carried out.

A known device for creasing stock is described in international patent application WO 00/55080. The device consists of a first drum mounted on a first rotary shaft, the first drum having at least one groove for holding a resilient ring that protrudes from the groove. A second drum is mounted on a second, parallel rotary shaft and has at least one corresponding groove. When the resilient ring protruding from the first drum is aligned with the groove of the second drum, a sheet of the stock fed between the two rotating drums will be creased by the pressure of the resilient ring deforming the paper into the groove of the second drum.

The first and second parallel shafts may conveniently be the top and bottom shafts of a conventional folding machine. The first drum is clamped on the first shaft so that the drum and the resilient ring rotate with the shaft. The second drum may be clamped on the second shaft with the corresponding grooves in alignment. Alternatively, as described in international patent application WO 2004/073966, the second drum may be mounted on bearings so that it can rotate independently of the second shaft and in a preferred arrangement can also slide axially along the second shaft.

A first problem with the aforementioned prior art is that the resilient ring must be stretched beyond its working diameter in order to pass over the outer surface of the drum and reach the groove. Despite the resilience of the ring, this stretching—particularly if done repeatedly during the lifetime of the ring—may cause the ring to lengthen so that it does not retract fully into the groove and does not have sufficient tension to grip the groove tightly. As a result, creasing may become less reliable and—because a loosely held ring is continuously deformed as the drum turns—the lifetime of the ring may be shortened.

A second problem with the aforementioned prior art is that a new ring can only be added to the creasing device by removing the shaft from the machine in which it is mounted. Although the device may provide space for storage of spare rings, their lifetime is limited and the rings will eventually need to be replaced. The difficulty of removing the shaft varies between machines but is always a time-consuming operation, during which the entire machine cannot be used for any of its functions.

BRIEF SUMMARY OF THE INVENTION

The invention provides a drum for a creasing device, comprising a first drum part having a cylindrical outer surface and a bore for mounting the first drum part about a shaft; and a second drum part having a cylindrical outer surface and a bore for mounting the second drum part about the shaft; wherein the first and second drum parts are shaped such that the two drum parts may abut one another to define between them the base and two side walls of a channel for receiving a resilient creasing ring; and wherein at least one side wall of the channel is recessed so that a resilient creasing ring located in the channel and projecting laterally into the recess cannot be withdrawn radially from the channel.

Forming the drum in two parts, with the channel defined at the junction of the two parts, allows the drum to be assembled round the resilient creasing ring, rather than stretching the ring to pass around the drum. In particular, the ring may be slid into place against the first drum part by a predominantly axial movement, so that the ring is not stretched beyond its working diameter, before the second drum part is brought into abutment to complete the channel. Preferably, the first drum part is shaped to define the base and one side wall of the channel; while the second drum part is shaped to define the other side wall of the channel. This allows the ring to be seated securely against the base of the channel before the second drum part is brought into abutment.

Once the two drum parts are locked in their abutting relationship to define the channel between them, the interlocking geometry of the recessed channel walls and the ring holds the ring in place in the channel. It is no longer required that the ring be under tension to hold it in place so a split ring can be used and can be added to the device without removing the shaft from the machine in which it is mounted.

To achieve the purpose of the recess—that a resilient creasing ring located in the channel and projecting laterally into the recess cannot be withdrawn radially from the channel—it is sufficient that, when the channel is viewed looking radially inwards, some part of the channel is hidden from view. This includes but is not limited to the case where the mouth of the channel is the narrowest part. "Recess" and cognate words are used in this specification in that sense.

Preferably the cross section of the channel has a generally flat base and two side walls converging from their junction with the base towards the mouth of the channel. Such a channel can accommodate a resilient ring of "dovetail" cross-section and it allows the flat base to be the widest part of the channel, whereby the ring is securely located and retained within the channel.

In a preferred embodiment of a drum according to the invention, the first drum part has an outwardly facing guide surface of smaller radius than the outer cylindrical surface; and the second drum part has an inwardly facing surface that slides on the guide surface of the first drum part to bring the two drum parts into axial abutment. The guide surface of the first drum part may ramp up to the base of the channel to assist in expanding a continuous resilient ring to its working diameter; or the guide surface may be a cylindrical surface that also forms the base of the channel to assist in locating a split ring.

The second drum part may be in the form of a collar that slides solely on the guide surface of the first drum part, the inwardly facing surface of the second drum part being constituted by the bore of the second drum part.

The invention also provides a resilient creasing ring for a creasing device, the ring comprising a radially projecting creasing rib and at least one lateral rib for location in a recessed side wall of a channel in a drum of the creasing device. As previously described, the ring may be split to form two abutting ends to make it possible to add the ring to the device without dismounting the shaft.

Finally, the invention provides a method of mounting a resilient creasing ring in the drum of a creasing device, comprising the steps of locating the resilient creasing ring against a base and one side wall of a channel defined by a first drum part; and axially sliding a second drum part into abutment with the first drum part, whereby the resilient creasing ring is also located against a second side wall of the channel defined by the second drum part.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
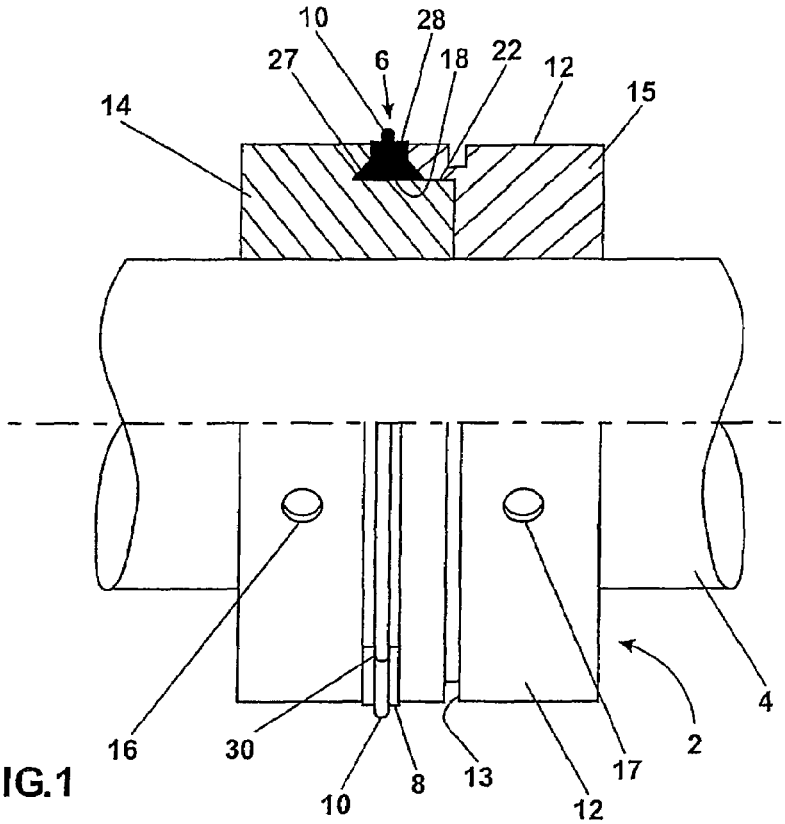
FIG. 1 illustrates a first embodiment of drum according to the invention, the upper half being shown in longitudinal section.

FIG. 1 shows a drum 2 mounted on a rotary shaft 4 which forms part of a creasing device. The drum 2 defines a channel 6 in which is received a resilient creasing ring 8 such that a creasing rib 10 of the ring 8 projects above a cylindrical outer surface 12 of the drum 2. In use, the illustrated drum 2 is placed adjacent to another, female drum (not shown) mounted on a second, parallel shaft (not shown), as is well known from the prior art. The female drum may be fixedly mounted for rotation with the second shaft but preferably it is free to rotate independently of the second shaft and to slide axially along the second shaft. The female drum has at least one circumferential groove around its cylindrical outer surface, which receives the creasing rib 10. As the male drum 2 of this invention rotates and the female drum counter-rotates, a sheet of paper, card or other stock fed between the creasing rib 10 of the male drum and the circumferential groove of the female drum them is deformed and creased.

The drum 2 shown in FIG. 1 itself has a circumferential groove 13 in the outer surface 12. This allows an identical drum 2 to be used, inverted, as the female drum on the second shaft to form a crease. Moreover, if the identical drum also carries a creasing ring 8, then the creasing rib 10 of each drum can engage the groove 13 of the other drum so as to form a closely spaced pair of creases (e.g. 6 mm apart), one up and one down, which is useful for applications such as the covers of catalogues and directories.

The drum 2 comprises a first drum part 14 and a second drum part 15. Each drum part 14,15 is annular in shape with a central bore that fits closely around the shaft 4. Grub screws 16,17 can be tightened to clamp the respective drum parts 14,15 to the shaft 4 or loosened to allow the drum parts 14,15 to slide along the shaft 4.

The channel 6 for retaining the creasing ring 8 (shown also in FIG. 3*a*) is located in the outer surface 12 of the drum 2 at the junction between the two drum parts 14,15. The first drum part 14 defines the base 18 and a first side wall 20 of the channel 6, while the second drum part defines a second side wall 21 of the channel 6. The base 18 of the channel is formed by part of an outwardly facing, cylindrical guide surface 22 of the first drum part 14, which has a smaller radius than the cylindrical outer surface 12. The second drum part 15 has a corresponding, inwardly facing, cylindrical guide surface 24, which slides along the guide surface 22 of the first part until facing end surfaces of the respective parts 14,15 come into abutment.

The channel 6 has a generally rectangular cross section but each side wall 20,21 has an undercut 26, whereby the channel 6 is wider at its base 18 than at its mouth. The resilient creasing ring 8 has a corresponding cross section, with a broad base tapering to a narrower body. Alternatively, this can be viewed as a body of generally rectangular cross section with lateral ribs 27 extending into the undercut recesses 26 of the side walls 20,21 of the channels 6. The creasing rib 10 projects radially outwardly from the creasing ring 8; and on each side of the creasing rib 10 is an outwardly facing resilient surface 28. The resilient surface stands very slightly proud of the cylindrical outer surface 12 of the drum 2 so that it can provide traction to stock that is fed through the creasing device and assist or replace dedicated traction bands known in the prior art.

Because the creasing ring 8 will be held in place by the interlocking geometry of the recessed side walls 20,21 of the channel 6 and the lateral ribs 27 of the ring 8, the creasing ring 8 does not need to be under tension around the drum 2. Therefore the creasing ring 8 may be split at a point 30 around its circumference. The split may be formed either by moulding the ring originally with the split in place or by moulding a continuous ring which is subsequently cut. Alternatively, if the thickness of the ring and the curvature of the channel are not too great, then the ring 8 may be moulded or extruded as a straight strip and subsequently wrapped around the drum 2 to form a ring in situ.

The drum 2 is assembled in the following manner. The two drum parts 14,15 are mounted on the shaft 4 and the grub screw 16 is tightened to lock the first drum part 14 in the correct axial position for a creasing ring 8 located in the channel 6 to form a crease at the desired point. Next a creasing ring 8 is located on the first drum part 14. The ends of the ring 8 may be separated at the split 30 and the resilient ring 8 deformed to pass the gap between the ends over the shaft. The base of the ring 8 is then wrapped around the guide surface 22 of the first part 14 and slid axially so that the ring 8 engages the side wall 20 of the channel 6 with a lateral rib 27 located in the undercut recess 26. The two ends of the split ring 8 should meet perfectly so that there is no gap in the creasing rib 10. Next, the second drum part 15 is slid axially along the shaft 4 and along the guide surface 22 of the first drum part 14 until the facing end surfaces of the respective parts 14,15 abut one another, at which point the second lateral rib 27 of the creasing ring 8 is located in the undercut 26 of the second side wall 21 of the channel 6. The grub screw 17 is tightened to lock the second drum part 15 in position. The sequence may be reversed to remove or exchange a creasing ring 8.

Figure 2:
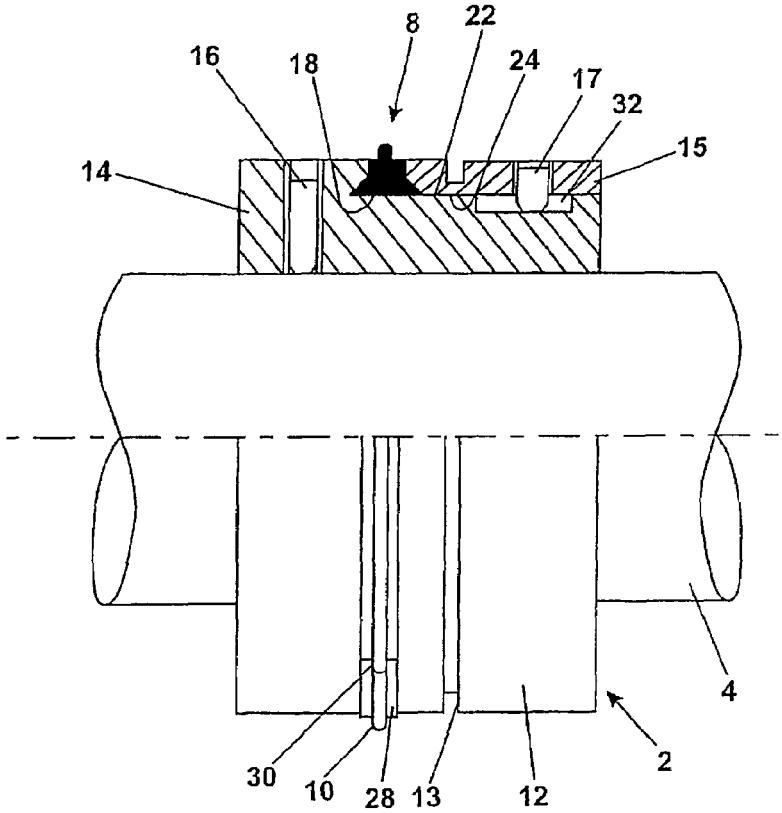
FIG. 2 illustrates a second embodiment of drum according to the invention, the upper half being shown in longitudinal section.

FIG. 2 illustrates an embodiment of the invention similar to that shown in FIG. 1. Corresponding parts are given the same reference numerals and their description will not be repeated here. The main difference is that in this embodiment the first drum part 14 extends over the whole axial length of the drum 2; and the second drum part 15 does not contact the shaft but takes the form of a collar sliding solely on the guide surface 22 of the first drum part.

The cross section in FIG. 2 is taken through the grub screws 16 and 17. Grub screw 16 is the same as in FIG. 1 and turns in a threaded bore to bear against the shaft 4 and lock the first drum part 14 in position. Compared with FIG. 1, grub screw 17 is shorter and does not bear against the shaft 4 but against the first drum part 14. It could bear simply on the guide surface 22 but, as shown, it is preferred that it runs in a keyway 32 cut into the guide surface 22. The keyway 32 could be of any circumferential extent but it is preferred that it should be essentially a linear channel, parallel to the axis, at one circumferential position around the guide surface 22. The keyway 32 stops short of the end of the drum 2 so that when grub screw 17 is loosened slightly, the second drum part 15 can be slid axially along the guide surface 22 of the first drum part 14 until the grub screw 17 reaches the end of the keyway 32. That opens the channel 6 enough for a resilient ring 8 to be inserted or removed but prevents the second drum part 15 from becoming detached from the first drum part 2 without unscrewing the grub screw 17 further.

FIG. 3 shows various possible cross sections for the channel 6, though many others can readily be imagined. The junction between the first and second drum parts 14,15 is not shown in these drawings because it may intersect the base 18 of the channel 6 at various points and at various angles.

Figure 3A:
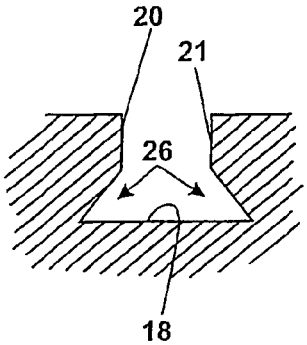
FIGS. 3*a*-3*f* illustrate alternative channel cross sections for use in a creasing device according to the invention.

FIG. 3*a* is an enlargement of the channel 6 of FIGS. 1 and 2. It has a broad, flat base 18 and the vertical side walls 20,21 are undercut at an angle to intersect the corners of the base 18 and form recesses 26.

Figure 3D:
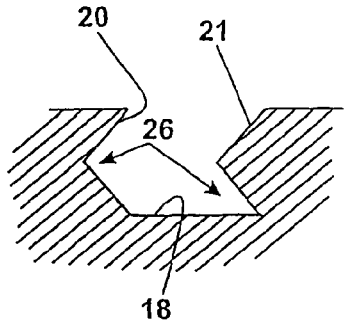
Figure 3B:
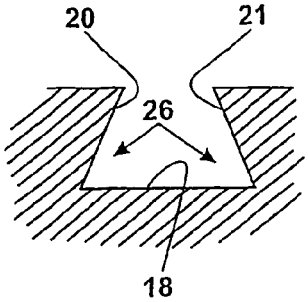

FIG. 3*b* shows a variant of the channel 6 in which the side walls 20,21 have no vertical part but are angled from the mouth of the channel to the corners of the base 18 to form recesses 26 over the whole depth of the channel.

Figure 3E:
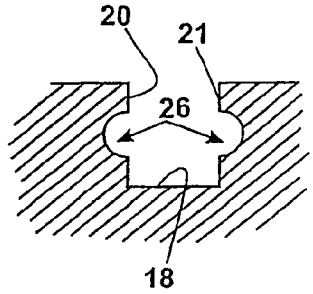
Figure 3C:
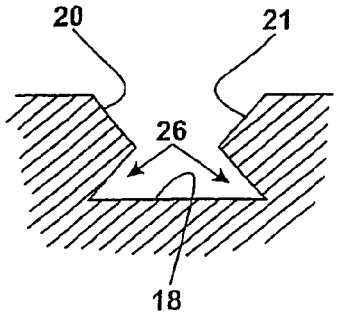

FIG. 3*c* shows that the narrowest part of the channel 6 need not be at the mouth.

FIG. 3*d* shows that recesses 26 can be provided even in a channel 6 of constant width, although this asymmetrical shape is not preferred.

FIG. 3*e* shows recesses 26 of semicircular cross section, which do not extend to the base 18 of the channel.

Figure 3F:
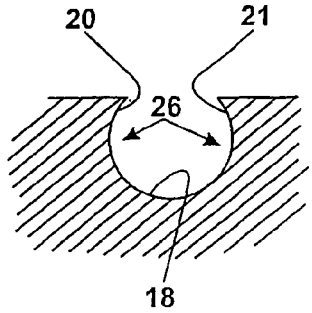

FIG. 3*f* shows a channel 6 of circular cross-section, in which there is no clear boundary between the side walls 20,21 and the base 18. This cross-section still has recesses 26 as previously defined because parts of the channel adjacent to the side walls 20,21 are not visible when viewed from above.

Figure 4:
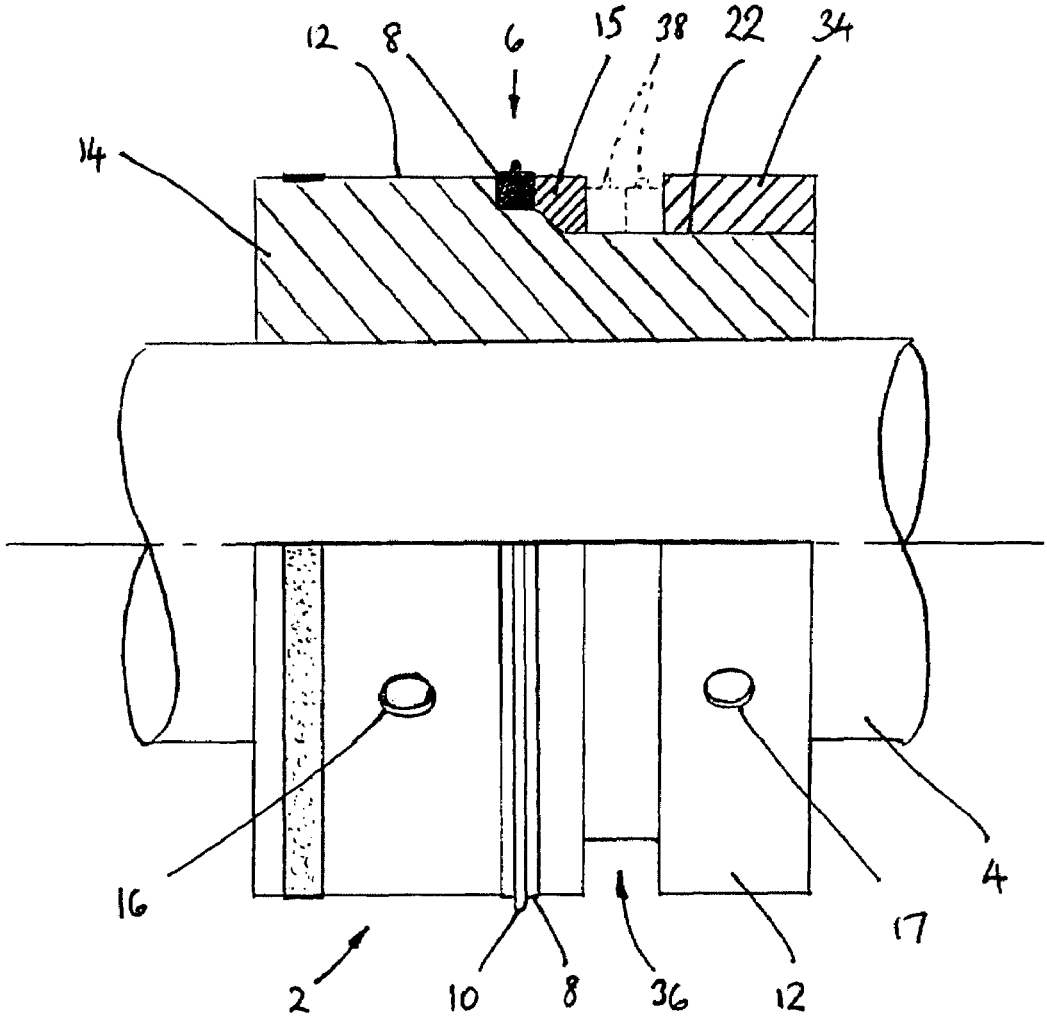
FIG. 4 illustrates a third embodiment of drum according to the invention, the upper half being shown in longitudinal section.

FIG. 4 shows an embodiment of the invention that is generally similar to FIG. 2 and the description of like parts will not be repeated. A third drum part 34 is provided which, like the second drum part 15, is in the form of a collar sliding on the guide surface 22 of the first drum part 14. The third drum part 34 may be axially spaced from the second drum part 15 to create a storage channel 36, which can store spare resilient creasing rings 38 when they are not in use.

It will be understood that the embodiments of the invention described here are illustrative only and not limiting. In particular, features shown here in separate embodiments may be used together in various combinations.

Although in the illustrated embodiments the second drum part 15 is shown to be sliding on the guide surface 22 of the first drum part 14 and locked in place by a grub screw 17, it could alternatively be mounted via a screw-threaded connection, provided that care is taken to secure the part 15 against unscrewing as the drum 2 rotates.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A resilient creasing ring for a creasing device, the ring comprising a radially projecting creasing rib and at least one lateral rib for location in a recessed side wall of a channel in a drum of the creasing device, and an outwardly facing traction surface adjacent to the creasing rib.

2. A resilient creasing ring for a creasing device, the ring when viewed in cross-section having the general form of a rectangle defining a flat inner surface forming a seat and a flat outer surface forming a traction surface from which a creasing rib radially projects.

3. A resilient creasing ring according to claim 2, wherein the outer surface has a first width and the creasing rib has a second width, parallel to the first width, that is less than the first width.

4. A resilient creasing ring according to claim 3, wherein the flat inner surface and the flat outer surface defines a first height therebetween and creasing rib extends a second height from the flat outer surface, the first height being greater than the second height.

5. The resilient creasing ring of claim 3, wherein the flat inner surface has a third width, the third width being equal to the first width.

6. A resilient creasing ring according to claim 2, wherein a first portion of the traction surface is on one lateral side of the creasing rib and a second portion of the traction surface is on an opposite lateral side of the creasing rib, such that the creasing rib is bounded on both sides by the traction surface, the first and second portions being substantially co-planar.

7. The resilient creasing ring of claim 6, wherein the cross-section having the general form of a rectangle when viewed in cross-section includes first and second lateral side surface portions that extend radially inward toward the flat inner surface from opposite edges of the outer flat surface.

8. The resilient creasing ring of claim 7, wherein the first and second lateral side surface portions are parallel to one another and extend perpendicular to the inner and outer flat surfaces.

* * * * *